US010518157B2

(12) United States Patent
Seidman et al.

(10) Patent No.: US 10,518,157 B2
(45) Date of Patent: Dec. 31, 2019

(54) TRAINING APPARATUS FOR COMBAT SPORTS

(71) Applicant: Joseph Richards Group, LLC, Ambler, PA (US)

(72) Inventors: Richard Seidman, Ambler, PA (US); Joseph McMullan, Philadelphia, PA (US)

( * ) Notice: Subject to any disclaimer, the term of this patent is extended or adjusted under 35 U.S.C. 154(b) by 0 days.

(21) Appl. No.: 16/032,794

(22) Filed: Jul. 11, 2018

(65) Prior Publication Data

US 2019/0022499 A1 Jan. 24, 2019

Related U.S. Application Data

(60) Provisional application No. 62/534,078, filed on Jul. 18, 2017.

(51) Int. Cl.

| | |
|---|---|
| ***A63B 69/34*** | (2006.01) |
| ***A63B 71/00*** | (2006.01) |
| ***A63B 21/06*** | (2006.01) |
| ***A63B 69/00*** | (2006.01) |

(Continued)

(52) U.S. Cl.

CPC ..... *A63B 69/345* (2013.01); *A63B 71/0054* (2013.01); *A63B 21/06* (2013.01); *A63B 22/20* (2013.01); *A63B 23/047* (2013.01); *A63B 69/002* (2013.01); *A63B 2071/0063* (2013.01); *A63B 2243/007* (2013.01); *A63B 2244/104* (2013.01); *A63B 2244/108* (2013.01)

(58) Field of Classification Search

CPC ..... A63B 69/345; A63B 22/20; A63B 69/002; A63B 21/06; A63B 2243/007

See application file for complete search history.

(56) References Cited

U.S. PATENT DOCUMENTS

| | | | | |
|---|---|---|---|---|
| 3,888,481 | A | 6/1975 | Adams, Jr. | |
| 2006/0035764 | A1* | 2/2006 | Webber ..... | A63B 21/06 482/94 |
| 2006/0116250 | A1 | 6/2006 | Adams | |

(Continued)

OTHER PUBLICATIONS

Suples® Attacker Dummy (harness dummy). Product information webpage [online]. Suples Ltd., 2018 [retrieved on Jul. 11, 2018]. Retrieved from the Internet: <URL: https://suples.com/dummies/dummy-attacker.php>.

(Continued)

*Primary Examiner* — Jeffrey S Vanderveen

(74) *Attorney, Agent, or Firm* — Matthew M. Yospin; Law Office of Matthew M. Yospin

(57) ABSTRACT

Apparatus is provided for training people in technique and tactics for use in wrestling and other combat sports. The apparatus presented comprises a rigid and elastic frame, padding, low-friction feet or runners, and a platform for another user or weights, to add mass and resistance for the user training with the apparatus. A user may use the apparatus to practice penetration techniques, agility, and strength while training in free motion. The apparatus leads the user to use her or his body weight, the weight of the apparatus, and optionally added weight, in training while on matted surfaces, providing a better training experience and practice than prior art training devices. The present invention solves problems with the currently available means and apparatuses of practicing penetration techniques and tactics.

5 Claims, 5 Drawing Sheets

(51) Int. Cl.
*A63B 22/20* (2006.01)
*A63B 23/04* (2006.01)

(56) References Cited

U.S. PATENT DOCUMENTS

| | | | | |
|---|---|---|---|---|
| 2010/0203986 | A1 | 8/2010 | Gilman | |
| 2013/0095984 | A1* | 4/2013 | Agate | A63B 21/0618 482/106 |
| 2013/0184104 | A1* | 7/2013 | Gilman | A63B 69/345 473/445 |
| 2018/0250569 | A1* | 9/2018 | Ragen | A63B 69/002 |

OTHER PUBLICATIONS

Snap and Shoot Plus. Product information webpage [online]. A+W Wrestling Equipment, Inc., 2018 [retrieved on Jul. 11, 2018]. Retrieved from the Internet: <URL: https://www.aw-wrestling.com/snapandshoot/#.W0YhKthKhTZ>.

* cited by examiner

TRAINING APPARATUS FOR COMBAT SPORTS

FIELD OF THE INVENTION

The presently disclosed subject matter relates to providing apparatus for training in wrestling and other combat sports, and more particularly, to apparatus for practicing penetration techniques and tactics.

BACKGROUND OF THE INVENTION

In training for wrestling and other combat sports and disciplines, including but not limited to mixed martial arts, capoeira, and Brazilian jiu-jitsu, a person must learn and practice what are referred to as penetration techniques and tactics. Penetration, in this context, refers to the act and process of stepping into one's opponent, by stepping forward with one foot and moving one's hips forward. There are multiple tactics by which one can penetrate into an opponent. Existing apparatus and training devices allow a user to practice grappling and improve necessary strength, but do not allow a user to practice penetration techniques while in free motion across a matted surface, meaning a surface covered with padded mats such as those on which wrestling practice and matches take place. To develop and practice the penetration techniques, a person must be able to freely move around on the matted surface, so that the person can practice stepping forward into the opponent and moving one's hips forward to drive the opponent backward, while grapping with the opponent. Prior art devices, such as U.S. Pat. No. 3,888,481 to Adams, Jr. et al. (the '481 patent) and US Patent Application 2006/0116250 by Adams and Walker, Jr. (the '250 application), allow a user to grapple with a dummy figure of a person, which dummy is mounted on springs attached to a framework, but which framework is not safely moveable across a matted surface. Neither the '481 patent nor the '250 application allow a user to practice penetration techniques while in free motion across a matted surface, limiting their usefulness in training for wrestlers and other combat sport trainees. Non-patented products exist as well, such as the "attacker dummy" and "snap and shoot plus" disclosed in the Information Disclosure Statement by Applicant filed with this application, and which examples contain the same shortcomings as patent-literature prior art: the "snap and shoot plus" and similar products are bolted to a wall, precluding practice in free motion across a surface, among other shortcomings; and the "attacker dummy" cannot be a stable object that a practitioner could use to practice shooting and other penetration techniques while driving an opponent backwards across a surface.

Other devices exist for training users in grappling and movement in other contexts, such as in blocking in football. A football blocking sled does allow a user to train in grabbing another person and pushing them, but this is not the same as penetration techniques and tactics. A football blocking sled, such as US Patent Application 2010/0203986 by Gilman (the '986 application), presents a blocking-practice apparatus that may be loaded with weights to provide varying amounts of resistance, and which may be used on a playing-field surface, such as grass, dirt, or artificial turf. But the '986 application does not allow for use on a matted surface, which it would tear up and destroy. It also is not useable for practicing penetration techniques because the geometry of the uprights is conducive to practicing grabbing an opponent by the torso or arms, but not practicing grabbing an opponent by the waist or legs, as the uprights are too far apart from each other. Furthermore, the arrangement of the components comprising the '986 application are conducive to training a user to grapple with an opponent and pushing into them with the user's torso and midsection while driving with the user's legs behind the user. In contrast, when practicing penetration techniques, the user must practice driving into the opponent's midsection and getting the user's center of gravity low so as to drive one of the user's legs between the opponent's legs—which is referred to as "shooting"—in order to take down the opponent—meaning drag them down onto the matted surface to pin them. The '986 application, and other prior art aimed at practicing football blocking (or other blocking for field sports), cannot allow a user to practice shooting, because there either is not space for the user's leg to go between the uprights, or there is a cross brace situated so close to the uprights that the user would damage his or her leg in the process.

Finally, the prior art does not allow a user to practice penetration techniques in free motion on a mat, solo. Practice against other people is always useful, but at times, it is helpful for the person practicing and for others, such as a coach, to be able to practice alone, to focus on their own techniques. The present invention allows a user to practice penetration techniques and tactics alone, and also with a partner as weight on the apparatus. In summary, the problems of the prior art are a lack of suitable apparatus for practicing penetration techniques, for practicing solo, for practicing penetration techniques in free motion, and for practicing on matted surfaces.

SUMMARY OF THE INVENTION

The present invention meets all these needs, by disclosing apparatus that allows a user to practice penetration techniques and tactics on matted surfaces without damaging the surface; that allow a user to fully practice penetration techniques without injuring themselves; that allow a user to practice while in free motion, as opposed to constrained to one place; and that allow a user to practice solo. The present invention relates broadly to apparatus for practicing techniques used in wrestling and combat sports, and more particularly to apparatus for practicing grappling and penetration techniques and tactics. The goals of the present invention are to allow a user to practice relevant penetration techniques in training on wrestling or similar mats. The present invention further addresses the problem of other apparatus that constrain the user to one place while practicing, whereas in a match setting the user needs to be in motion across the mats.

The present invention addresses the problems of the prior art, which do not present apparatus for training that allow practice of penetration techniques and tactics on matted surfaces without damaging the surface and without injuring the user, and that allow a user to practice while in free motion. The present invention meets these needs.

Further, the present invention introduces a product that allows a user to practice solo, improving the opportunities for practice, as a suitable wrestling opponent is not always available in practice, and improving the ability of others to observe and coach a user, as the only variable is the user's technique, not the actions of an opponent, so a coach and the user can focus on the user's own technique.

These aspects of the present invention, and others disclosed in the Detailed Description of the Drawings, represent improvements on the current art. This summary is provided to introduce a selection of concepts in a simplified form that are further described below in the Detailed Description of the Drawings. This Summary is not intended to identify key features or essential features of the claimed subject matter, nor is it intended to be used to limit the scope of the claimed subject matter.

BRIEF DESCRIPTION OF THE DRAWINGS

The foregoing summary, as well as the following detailed description of various embodiments, is better understood when read in conjunction with the appended drawings. For the purposes of illustration, the drawings show exemplary embodiments; but the presently disclosed subject matter is not limited to the specific methods and instrumentalities disclosed. In the drawings, like reference characters generally refer to the same components or steps of the device throughout the different figures. In the following detailed description, various embodiments of the present invention are described with reference to the following drawings, in which.

DETAILED DESCRIPTION OF THE DRAWINGS

Figure 1:
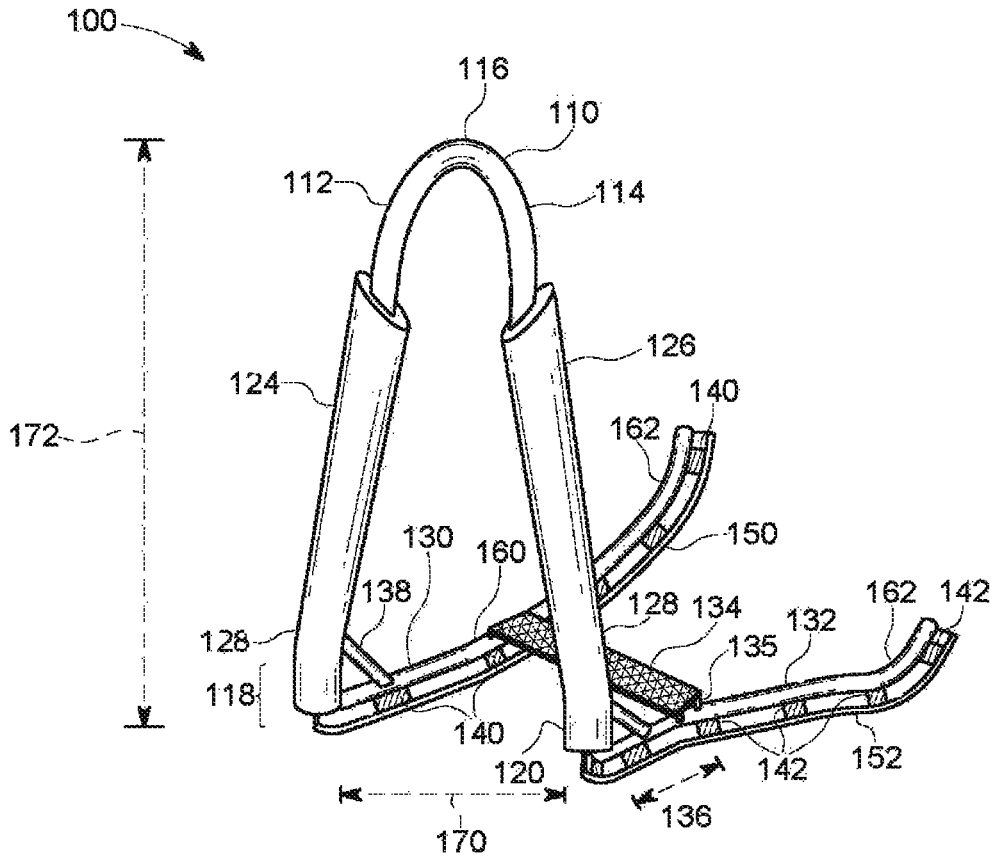
FIG. 1 shows a front and top perspective view of an embodiment of the apparatus of the present invention.

The presently disclosed invention is described with specificity to meet statutory requirements. But, the description itself is not intended to limit the scope of this patent. Rather, the claimed invention might also be embodied in other ways, to include different steps or elements similar to the ones described in this document, in conjunction with other present or future technologies. Moreover, although the term "step" or similar terms may be used herein to connote different aspects of methods employed, the term should not be interpreted as implying any particular order among or between various steps herein disclosed unless and except when the order of individual steps is explicitly described.

In the following description, numerous specific details are set forth to provide a thorough understanding of the invention. But, the present invention may be practiced without these specific details. Structures and techniques that would be known to one of ordinary skill in the art have not been shown in detail, in order not to obscure the invention. Referring to the figures, it is possible to see the various major elements constituting the apparatus and methods of use the present invention.

The present invention comprises a novel apparatus 100 for practicing techniques and tactics for combat sports, including but not limited to wrestling, mixed martial arts, capoeira, and Brazilian jiu-jitsu.

With reference to FIGS. 1, 2, 3, and 4, the apparatus 100 of the present invention comprises a grappling upright 110, a first horizontal tube 130, a second horizontal tube 132, a first horizontal brace 134, a plurality of horizontal brace supports 135, a plurality of upright-horizontal braces 138, a first horizontal runner 150, and a second horizontal runner 152. The grappling upright 110 further comprises an upright first side 112 and an upright second side 114, which, it has been found advantageous, are formed or joined to each other with a grappling top angle 116 between the upright first side 112 and the upright second side 114. The grappling top angle 116, it has been found advantageous, may be approximately 160° to 162°, for reasons described below. The upright first side 112 and the upright second side 114 are then straight for approximately 36".

The grappling upright 110 further comprises a grappling first side vertical section 118 which is at a grappling lower angle 128 of approximately 9°-10° relative to the upright first side 112; and a grappling second side vertical section 120 which is at a grappling lower angle 128 of approximately 9°-10° relative to the upright second side 114. The upright first side 112 and the upright second side 114 and the grappling first side vertical section 118 and the grappling second side vertical section 120 may, it has been found advantageous, be formed from a single tube or other piece of metal or other suitable material, or may be formed from separate pieces of material. Together, comprising the grappling upright 110, the upright first side 112, the upright second side 114, the grappling first side vertical section 118, and the grappling second side vertical section 120 should turn through approximately 180° of turns (the grappling lower angle 128 plus the grappling top angle 116 plus the grappling lower angle 128), such that the grappling first side vertical section 118 and the grappling second side vertical section 120 are both approximately vertical and parallel to each other, and are each, it has been found advantageous, approximately 6" to 8" long. Below the grappling first side vertical section 118 and the grappling second side vertical section 120 are, on each side, a grappling upright—horizontal tube joint 122, which may be a bend in the single piece of material comprising the grappling upright 110, or may be a joint between separate pieces of material.

The overall height of the grappling upright 110, from the bottoms of the grappling first side vertical section 118 and the grappling second side vertical section 120, through the upright first side 112 and the upright second side 114, to the top of the material of the grappling upright 110 at the top of the grappling top angle 116, is advantageously approximately 48", for reasons that are discussed below.

The sides of the grappling upright 110 are advantageously covered with a first upright pad 124 and a second upright pad 126, which may cover most or all of the upright first side 112, the upright second side 114, the grappling first side vertical section 118, and the grappling second side vertical section 120. The first upright pad 124 and the second upright pad 126 should be of a material or materials which provide sufficient padding to allow a user 210 to grapple and shove hard against the grappling upright 110 without undue injury to the user.

Below the grappling upright 110, and approximately perpendicular to the grappling upright 110, are the first horizontal tube 130 and the second horizontal tube 132. The first horizontal tube 130 and the second horizontal tube 132 may, it has been found advantageous, be formed from a single piece of material continuous with the grappling upright 110; or the grappling upright 110 may be joined to the first horizontal tube 130 and the second horizontal tube 132 at the grappling upright—horizontal tube joints 122. In either formation of the present invention, the materials used for the grappling upright 110, the first horizontal tube 130, and the second horizontal tube 132 should be sufficiently strong and elastic that they can endure energetic use and impacts which are typical in training for wrestling and other combat sports. The material used for the grappling upright 110 should be of sufficient diameter or cross-sectional size, if not circular) that it is comfortable for a typical range of users to grapple with when the material is wrapped in padding, such as the first upright pad 124 and the second upright pad 126. One such suitable material is steel tubing of approximately 1.5" outer diameter, though other materials and cross-sectional sizes are possible, including but not limited to aluminum, graphite, and materials now known or later invented. The grappling upright 110 may be braced to the first horizontal tube 130 and the second horizontal tube 132 with one or more upright-horizontal braces 138, advantageously with an upright-horizontal brace 138 on each side of the grappling upright 110.

The first horizontal tube 130 and the second horizontal tube 132 may, it has been found advantageous, each have a horizontal tube lateral bend 160, at which the first horizontal tube 130 turns laterally to the left, away from the center of the apparatus 100, and the second horizontal tube 132 turns laterally to the right, away from the center of the apparatus 100. The goals of the horizontal tube lateral bends 160 are to increase the lateral stability of the apparatus, by providing a wider base (the footprint of the first horizontal tube 130 and the second horizontal tube 132, as seen in FIG. 4) that resists tipping of the apparatus 100. The horizontal tube lateral bends 160 may be located on the first horizontal tube 130 and the second horizontal tube 132 forward (closer to the grappling upright 110) of the first horizontal brace 134, as shown in FIGS. 1, 3, and 4.

Figure 3:
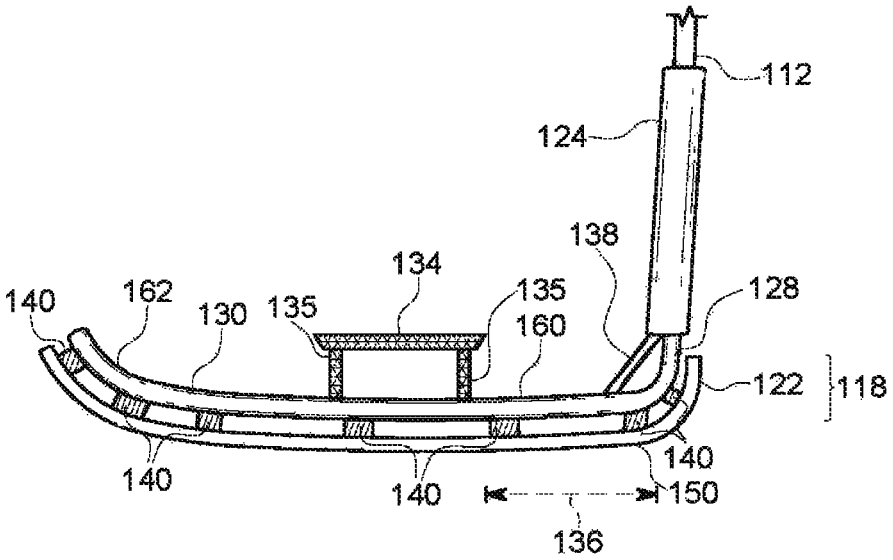
FIG. 3 shows a side elevation view of an embodiment of the apparatus of the present invention.
Figure 4:
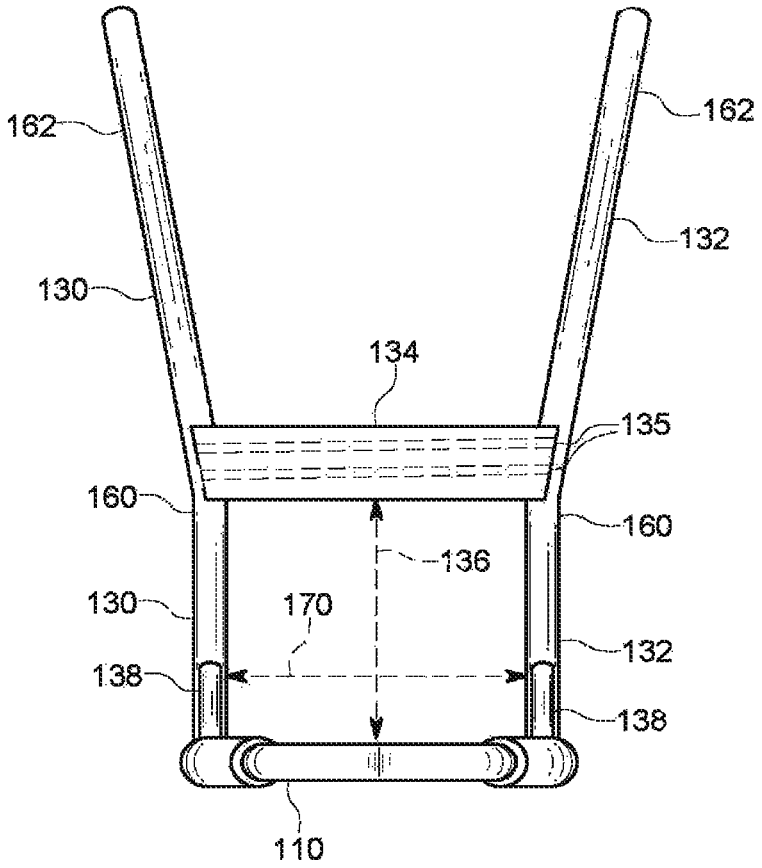
FIG. 4 shows a top elevation view of an embodiment of the apparatus of the present invention.

The first horizontal tube 130 and the second horizontal tube 132 may, it has been found advantageous, each have a horizontal tube upright bend 162, at which the first horizontal tube 130 turns vertically up, away from the mat, and the second horizontal tube 132 turns vertically up, away from the mat, as shown in FIG. 3. The goals of the horizontal tube upright bends 162 are to allow the apparatus 100 to tip backwards as the user 210 drives into it, and to be moved backwards while the user 210 drives into the apparatus 100, without having the edges or ends of the first horizontal runner 150 and the second horizontal runner 152 impact the mat, which could result in damage to the mat. If the user's 210 practice of technique with the apparatus 100 tips the apparatus backwards (moving the top of the grappling upright 110 away from the user 210 and closer to the mat), the upturned ends of the first horizontal runner 150 and the second horizontal runner 152 allow the apparatus 100 to be driven backwards without digging into the mat. The horizontal tube upright bends 162 are advantageously placed near the back ends (the ends away from the grappling upright 110) of the first horizontal tube 130 and the second horizontal tube 132, as shown in FIG. 3.

Figure 2:
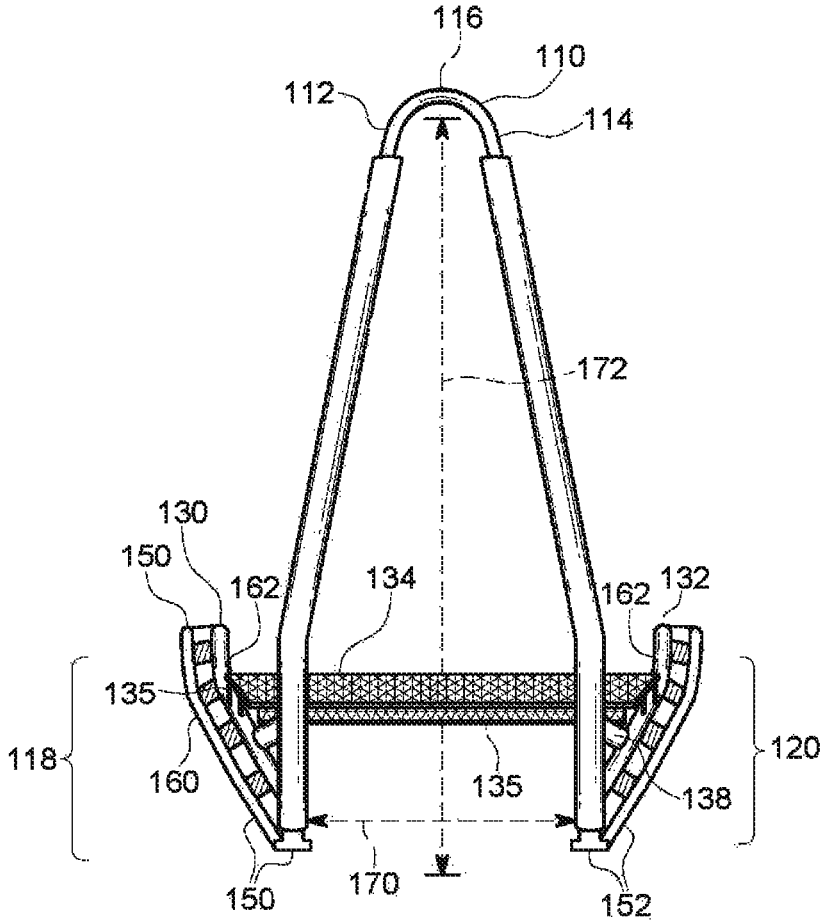
FIG. 2 shows a front elevation view of an embodiment of the apparatus of the present invention.

With reference to FIGS. 1, 2, and 3, the apparatus 100 further comprises a first horizontal runner 150 and a second horizontal runner 152. The first horizontal runner 150 is attached to and underneath the first horizontal tube 130, and the second horizontal runner 152 is attached to and underneath the second horizontal tube 132. The first horizontal runner 150 and the second horizontal runner 152 are, it has been found advantageous, made of or coated with a low-friction material so that the first horizontal runner 150 and the second horizontal runner 152 do not tear up or damage the padded wrestling mats on which the apparatus 100 is intended to be used in training for combat sports. In some embodiments of the present invention, the first horizontal runner 150 and the second horizontal runner 152 may be coatings applied to the undersides of the first horizontal tube 130 and the second horizontal tube 132. In other embodiments of the invention, as pictured in FIG. 3 and FIGS. 1, 2, 4, and 5, the first horizontal runner 150 and the second horizontal runner 152 may be separate pieces from the first horizontal tube 130 and the second horizontal tube 132, and may be attached to the first horizontal tube 130 and the second horizontal tube 132 with a plurality of first horizontal runner supports 140 (attaching the first horizontal runner 150 to the first horizontal tube 130) and a plurality of second horizontal runner supports 142 (attaching the second horizontal runner 152 to the second horizontal tube 132). The plurality of first horizontal runner supports 140 and the plurality of second horizontal runner supports 142 may space the first horizontal tube 130 and the second horizontal tube 132 away from the mats, above the first horizontal runner 150 and the second horizontal runner 152. Alternatively, the plurality of first horizontal runner supports 140 and the plurality of second horizontal runner supports 142 may snugly join the first horizontal tube 130 and the second horizontal tube 132 to the first horizontal runner 150 and the second horizontal runner 152. The goal of the first horizontal runner 150 and the second horizontal runner 152, in the present invention, is to provide a low-friction area of contact between the apparatus 100 and the mats, so that when a user 210 is grappling with the apparatus 100, the apparatus 100 can slide across the mats without damaging the mats.

Figure 5:
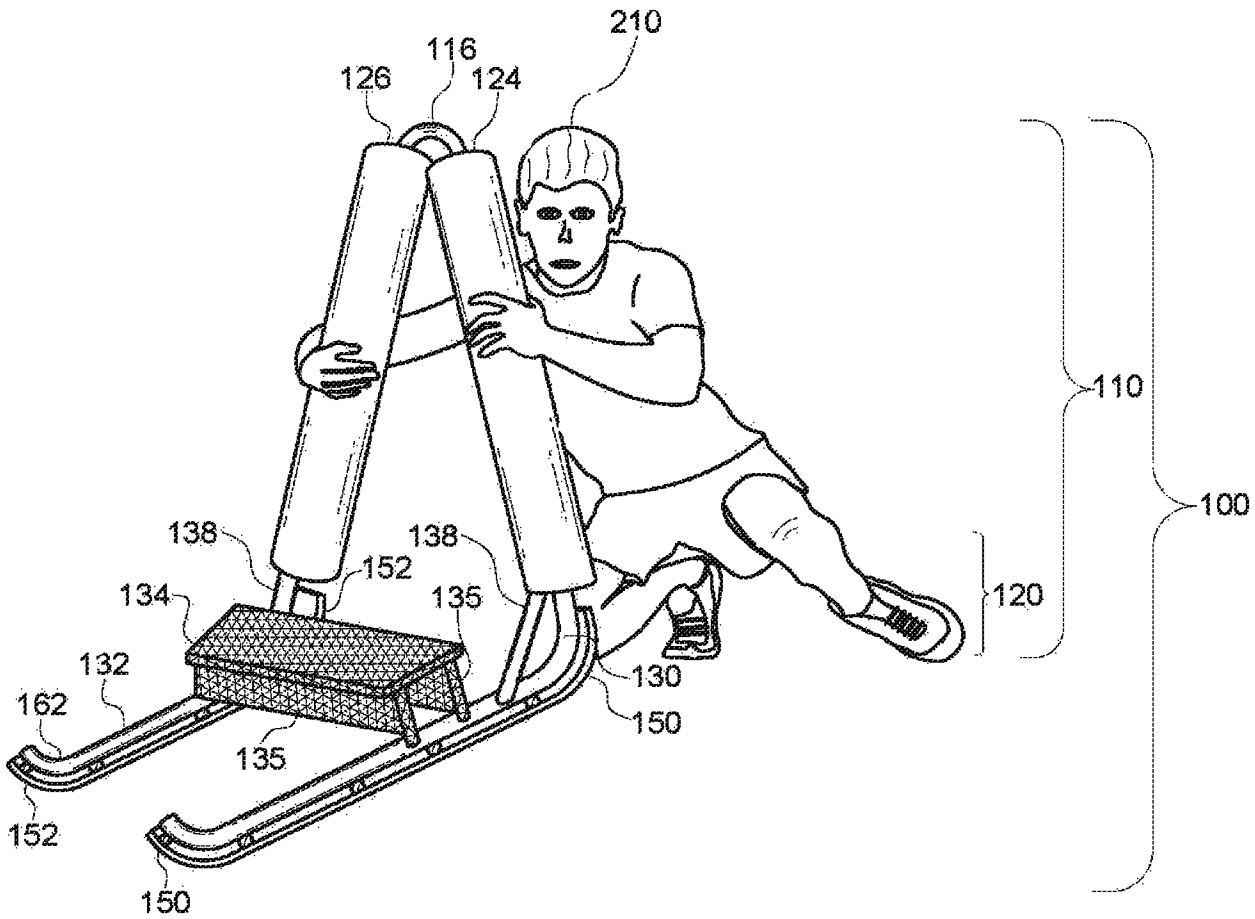
FIG. 5 shows a perspective view of an embodiment of the apparatus of the present invention, from the top and rear, with a user of the apparatus depicted as interacting with the apparatus at the front of the apparatus.

The front of the apparatus 100, namely the face of the grappling upright 110 with which the user 210 grapples with the user's torso, as shown in FIG. 5, is distant from the front of the first horizontal brace 134 by a distance referred to as a first horizontal brace setback 136, as marked in FIGS. 1, 3, and 4. The first horizontal brace setback 136 is approximately 16", to allow the user 210 to shoot a knee and leg between the upright first side 112 and the upright second side 114 of the grappling upright 110, to practice shooting and penetration techniques, without impacting the knee or leg of the user 210 on the first horizontal brace 134. It will be understood by one of skill in the art that other dimensions of the first horizontal brace setback 136 are possible, so as to allow a shorter or taller user 210 of the apparatus 100 to practice penetration techniques without injury. The goals of the first horizontal brace 134 are two-fold: first, to provide lateral stability to the apparatus 100, by bracing the first horizontal tube 130 to the second horizontal tube 132, reducing lateral flexion and twisting of the first horizontal tube 130 and the second horizontal tube 132 relative to each other; and second, to allow additional mass to be added to the apparatus 100 for training the user 210, for which the first horizontal brace 134 should, it has been found advantageous, be able to support additional mass. The additional mass may be another person, standing on the first horizontal brace 134, or may be weights. By adding mass to the apparatus, a user 210 can practice penetration and driving into an opponent of varying mass, which is necessary for training and development, and is one of the unmet needs of the prior art. The first horizontal brace 134 may be attached to the first horizontal tube 130 and the second horizontal tube 132 with a plurality of horizontal brace supports 135, or may be attached directly to the first horizontal tube 130 and the second horizontal tube 132. One advantage of using a plurality of horizontal brace supports 135 is that it raises the center of mass of the apparatus 100 and especially so with weights added to the first horizontal brace 134, more accurately simulating the height of the center of mass of an opponent.

With reference to FIGS. 1, 2, and 4, the apparatus 100 comprises an internal horizontal span 170 between the grappling first side vertical section 118 and the grappling second side vertical section 120. The internal horizontal span 170 should be, advantageously, approximately 14", to allow the user 210 sufficient lateral space to shoot in either knee and leg from a variety of body positions when grappling with the grappling upright 110, "shoot in" meaning, for the avoidance of doubt, insert a knee between, on the left, the upright first side 112 and the grappling first side vertical section 118, and on the right, the upright second side 114 and the grappling second side vertical section 120. It will be understood by one of skill in the art that other dimensions of the internal horizontal span 170 are possible. There is horizontal space between the upright first side 112 and the upright second side 114, which tapers down the higher up inside of the grappling upright 110 one measures.

The apparatus 100 further comprises, with reference to FIGS. 1 and 2, an internal vertical span 172, which is the distance from the undersides of the first horizontal runner 150 and the second horizontal runner 152 (where the first horizontal runner 150 and the second horizontal runner 152 contact the mats or other floor) to the underside of the grappling upright 110 at its highest region, the grappling top angle 116. The goal of the internal vertical span 172 is to allow users 210 of varying heights space to practice penetration by driving a portion of the user's 210 torso, shoulder, and/or hips into the space between the upright first side 112 and the upright second side 114, while driving forward into the grappling upright 110 and attempting to move the apparatus 100 backwards. The internal vertical span 172 may, it has been found advantageous, be approximately 48", though it will be understood by one of skill in the art that other dimensions of the apparatus 100 and thus the internal vertical span 172 are possible.

With reference to FIG. 5, to use the apparatus 100, the apparatus 100 may be placed on mats or other flooring, and a user 210 may grapple with the apparatus 100. In this way, the user 210 may grab the grappling upright 110 with the one or both of the user's 210 hands, while driving the user's 210 shoulder or hips into or towards the grappling upright 110. The user may also practice shooting a knee into the space between, on the user's 210 left, the upright first side 112 and the grappling first side vertical section 118, and on the right, the upright second side 114 and the grappling second side vertical section 120.

Certain embodiments of the present invention were described above. From the foregoing it will be seen that this invention is one well adapted to attain all the ends and objects set forth above, together with other advantages, which are obvious in and inherent to the inventive apparatus disclosed herein. It will be understood that certain features and sub-combinations are of utility and may be employed without reference to other features and sub-combinations. It is expressly noted that the present invention is not limited to those embodiments described above, but rather the intention is that additions and modifications to what was expressly described herein are also included within the scope of the invention. Moreover, it is to be understood that the features of the various embodiments described herein are not mutually exclusive and can exist in various combinations and permutations, even if such combinations or permutations were not made express herein, without departing from the spirit and scope of the invention. In fact, variations, modifications, and other implementations of what was described herein will occur to those of ordinary skill in the art without departing from the spirit and the scope of the invention. As such, the invention is not to be defined only by the preceding illustrative description.

Accordingly, what is claimed is:

1. An apparatus for practicing techniques for combat sports, the apparatus comprising:

a grappling upright, which further comprises an upright first side and an upright second side which upright first side and upright second side are joined to each other with a grappling top angle between the upright first side and the upright second side; and which further comprises a grappling first side vertical section which is at a grappling lower angle of 9°-10° relative to the upright first side, and a grappling second side vertical section which is at a grappling lower angle of 9°-10° relative to the upright second side, with an internal horizontal span between the grappling first side vertical section and the grappling second side vertical section;

a first horizontal tube;

a second horizontal tube;

a first horizontal brace;

a plurality of horizontal brace supports;

a plurality of upright-horizontal braces, which brace the grappling upright to the first horizontal tube and the second horizontal tube;

a first horizontal runner which is attached to and underneath the first horizontal tube; and a second horizontal runner which is attached to and underneath the second horizontal tube;

wherein the front of the apparatus is distant from the front of the first horizontal brace by a first horizontal brace setback distance; and in which the grappling top angle is 160° to 162°.

2. An apparatus for practicing techniques for combat sports, the apparatus comprising:

a grappling upright, which further comprises an upright first side and an upright second side which upright first side and upright second side are joined to each other with a grappling top angle between the upright first side and the upright second side; and which further comprises a grappling first side vertical section which is at a grappling lower angle of 9°-10° relative to the upright first side, and a grappling second side vertical section which is at a grappling lower angle of 9°-10° relative to the upright second side, with an internal horizontal span between the grappling first side vertical section and the grappling second side vertical section;

a first horizontal tube;

a second horizontal tube;

a first horizontal brace;

a plurality of horizontal brace supports;

a plurality of upright-horizontal braces, which brace the grappling upright to the first horizontal tube and the second horizontal tube;

a first horizontal runner which is attached to and underneath the first horizontal tube; and a second horizontal runner which is attached to and underneath the second horizontal tube;

wherein the front of the apparatus is distant from the front of the first horizontal brace by a first horizontal brace setback distance; and in which an internal vertical span of the apparatus is 48".

3. An apparatus for practicing techniques for combat sports, the apparatus comprising:

a grappling upright, which further comprises an upright first side and an upright second side which upright first side and upright second side are joined to each other with a grappling top angle between the upright first side and the upright second side; and which further comprises a grappling first side vertical section which is at a grappling lower angle of 9°-10° relative to the upright first side, and a grappling second side vertical section which is at a grappling lower angle of 9°-10° relative to the upright second side, with an internal horizontal span between the grappling first side vertical section and the grappling second side vertical section;

a first horizontal tube;

a second horizontal tube;

a first horizontal brace;

a plurality of horizontal brace supports;

a plurality of upright-horizontal braces, which brace the grappling upright to the first horizontal tube and the second horizontal tube;

a first horizontal runner which is attached to and underneath the first horizontal tube; and a second horizontal runner which is attached to and underneath the second horizontal tube;

wherein the front of the apparatus is distant from the front of the first horizontal brace by a first horizontal brace setback distance; and in which the first horizontal brace setback is 16".

4. An apparatus for practicing techniques for combat sports, the apparatus comprising:

a grappling upright, which further comprises an upright first side and an upright second side which upright first side and upright second side are joined to each other with a grappling top angle between the upright first side and the upright second side; and which further comprises a grappling first side vertical section which is at a grappling lower angle of 9°-10° relative to the upright first side, and a grappling second side vertical section which is at a grappling lower angle of 9°-10° relative to the upright second side, with an internal horizontal span between the grappling first side vertical section and the grappling second side vertical section;

a first horizontal tube;

a second horizontal tube;

a first horizontal brace;

a plurality of horizontal brace supports;

a plurality of upright-horizontal braces, which brace the grappling upright to the first horizontal tube and the second horizontal tube;

a first horizontal runner which is attached to and underneath the first horizontal tube; and a second horizontal runner which is attached to and underneath the second horizontal tube;

wherein the front of the apparatus is distant from the front of the first horizontal brace by a first horizontal brace setback distance; and in which the internal horizontal span is 14".

5. An apparatus for practicing techniques for combat sports, the apparatus comprising:

a grappling upright, which further comprises an upright first side and an upright second side with a grappling top angle between them, a grappling first side vertical section, and a grappling second side vertical section, with an internal horizontal span between the grappling first side vertical section and the grappling second side vertical section; wherein the grappling first side vertical section and the grappling second side vertical section are vertical and parallel to each other;

a first horizontal tube and a second horizontal tube, each joined to the grappling upright with a grappling upright—horizontal tube joint;

a first horizontal brace;

a plurality of upright-horizontal braces;

a first horizontal runner which is attached to and underneath the first horizontal tube; and a second horizontal runner which is attached to and underneath the second horizontal tube;

wherein the front of the apparatus is distant from the front of the first horizontal brace by a first horizontal brace setback distance; and in which the internal horizontal span is 14".

* * * * *